US010712000B2

(12) United States Patent
Ozeki et al.

(10) Patent No.: US 10,712,000 B2
(45) Date of Patent: Jul. 14, 2020

(54) ASH DISCHARGE SYSTEM

(71) Applicant: KAWASAKI JUKOGYO KABUSHIKI KAISHA, Kobe-shi, Hyogo (JP)

(72) Inventors: Yasutaka Ozeki, Kobe (JP); Yoshihiko Takemura, Kobe (JP); Tomoyuki Suzuki, Kobe (JP); Kei Takakura, Kobe (JP); Hiroshi Ito, Kobe (JP); Keiichi Mashio, Amagasaki (JP); Hiroshi Aoyagi, Amagasaki (JP); Takeshi Kawana, Kobe (JP); Akira Yamashita, Kobe (JP); Ryutaro Okada, Kobe (JP); Keita Tsunemori, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 30 days.

(21) Appl. No.: 16/060,153

(22) PCT Filed: Dec. 2, 2016

(86) PCT No.: PCT/JP2016/005050
§ 371 (c)(1),
(2) Date: Jun. 7, 2018

(87) PCT Pub. No.: WO2017/098712
PCT Pub. Date: Jun. 15, 2017

(65) Prior Publication Data

US 2019/0178492 A1 Jun. 13, 2019

(30) Foreign Application Priority Data

Dec. 7, 2015 (JP) ..... 2015-238675

(51) Int. Cl.
*F23J 1/02* (2006.01)
*B07B 1/12* (2006.01)
(Continued)

(52) U.S. Cl.
CPC ..... *F23J 1/02* (2013.01); *B07B 1/12* (2013.01); *B07C 5/342* (2013.01); *B07C 5/36* (2013.01);
(Continued)

(58) Field of Classification Search
CPC ..... B07C 5/36; F23J 2900/01001
See application file for complete search history.

(56) References Cited

U.S. PATENT DOCUMENTS 4,941,415 A * 7/1990 Pope ..... F23G 5/16 110/211
6,038,987 A * 3/2000 Koshinski ..... B02C 19/065 106/705
(Continued)

FOREIGN PATENT DOCUMENTS

CN 203718804 U 7/2014
DE 102005048959 A1 4/2007
(Continued)

OTHER PUBLICATIONS

Oct. 20, 2017 Taiwan Office Action and Search Report issued in Taiwan Patent Application No. 105140404.

*Primary Examiner* — David J Laux
(74) *Attorney, Agent, or Firm* — Oliff PLC

(57) ABSTRACT

An ash discharge system has a conveyor device which transports clinker ash out of a region that is below a furnace bottom of a boiler furnace; and a separation device provided at a passage of the clinker ash from the furnace bottom to the conveyor device, the separation device including a separator which permits the clinker ash with a predetermined size or less to pass through the separator, and inhibits a large-mass
(Continued)

clinker from passing through the separator, the large-mass clinker being the clinker ash with a size larger than the predetermined size.

10 Claims, 2 Drawing Sheets

(51) Int. Cl.

| | |
|---|---|
| ***B07C 5/342*** | (2006.01) |
| ***B07C 5/36*** | (2006.01) |
| ***F23G 5/44*** | (2006.01) |
| ***F23G 5/50*** | (2006.01) |
| ***F23J 1/06*** | (2006.01) |

(52) U.S. Cl.
CPC ..... *F23G 5/444* (2013.01); *F23G 5/50* (2013.01); *F23J 1/06* (2013.01); *F23J 2700/001* (2013.01); *F23J 2700/002* (2013.01); *F23J 2900/01001* (2013.01); *F23J 2900/01003* (2013.01); *F23J 2900/01009* (2013.01)

(56) References Cited

U.S. PATENT DOCUMENTS

| | | | | |
|---|---|---|---|---|
| 6,095,064 | A * | 8/2000 | Millard | F23G 5/16 110/344 |
| 2011/0297060 | A1 | 12/2011 | Moreno Rueda et al. | |
| 2012/0288804 | A1 * | 11/2012 | Moreno Rueda | F23J 1/06 431/12 |

FOREIGN PATENT DOCUMENTS

| | | | |
|---|---|---|---|
| JP | 2005-69512 | A | 3/2005 |
| JP | 2005-106435 | A | 4/2005 |
| WO | 2006/090954 | A1 | 8/2006 |

* cited by examiner

ASH DISCHARGE SYSTEM

TECHNICAL FIELD

The present invention relates to an ash discharge system which discharges ash from a furnace bottom of a boiler.

BACKGROUND ART

Conventionally, a coal burning boiler including a furnace which combusts crushed pieces of coal is known. Some of particles of coal combustion ash generated in the furnace of the boiler melt and clump together to form porous masses or lumps (clinker ash), which fall onto the furnace bottom.

As known methods of ash discharge processing for discharging the clinker ash from the furnace bottom of the furnace, there are a submerged conveyor method which continuously discharges the clinker ash by a submerged drag chain conveyor installed at the furnace bottom, and a dry clinker conveyor method which continuously or intermittently discharges the clinker ash by a dry clinker conveyor installed at the furnace bottom (see Patent Literature 1).

For example, a conveyor apparatus disclosed in Patent Literature 1 includes a conveyor belt having a collection area located below a bottom opening of a boiler furnace, and a housing surrounding the conveyor belt. High-temperature material discharged from the boiler furnace falls onto the conveyor belt, and is cooled while being transported by the conveyor belt.

CITATION LIST

Patent Literature

Patent Literature 1: US Patent Publication. No. 201110297060

SUMMARY OF INVENTION

Technical Problem

If the coal combustion ash melting in the boiler furnace adheres to, for example, a heat transfer pipe provided inside the furnace, or a wall of the furnace, this is grown and solidified into a large-mass (huge lump) clinker. If the large-mass clinker is grown to have a relatively large size, this large-mass clinker may fall due to its weight, a vibration, or the like.

In some cases, the above-described large-mass clinker has a long side of 1 m or more. The large-mass clinker in a high-temperature state remains unmoving on a conveyor. In these cases, an operator is required to insert a poking stick or the like through a check window provided at the conveyor and to crush the large-mass clinker into small pieces.

In light of this, inventors considered that the large-mass clinker is separated from a stream of the clinker ash transported along a predetermined path, and discharged to an outside region of the apparatus, and the clinker ash from which the large-mass clinker has been removed, is sent to a conveyor device.

The present invention has been developed in view of the above-described circumstances, and an object of the present invention is to provide an ash discharge system capable of separating a "large-mass clinker" which is a clinker with a size larger than a predetermined size, from a stream of clinker ash, in a passage of the clinker ash from the furnace bottom of a boiler furnace to a conveyor device, in a case where the system discharges ash from the furnace bottom of the boiler furnace.

Solution to Problem

According to an aspect of the present invention, there is provided an ash discharge system which discharges clinker ash from a furnace bottom of a boiler furnace, the ash discharge system comprising: a conveyor device which transports the clinker ash out of a region that is below the furnace bottom; and a separation device provided at a passage of the clinker ash from the furnace bottom to the conveyor device, the separation device including a separator which permits the clinker ash with a predetermined size or less to pass through the separator, and inhibits a large-mass clinker from passing through the separator, the large-mass clinker being the clinker ash with a size larger than the predetermined size.

In accordance with the above-described ash discharge system, in the passage of the clinker ash from the furnace bottom of the boiler furnace to the conveyor device, the large-mass clinker which is the clinker with a size larger than the predetermined size can be separated from a main stream of the clinker ash and removed. Therefore, only the clinker ash with the predetermined size or less falls onto the conveyor device. As a result, it becomes possible to prevent a situation in which the large-mass clinker remains unmoving on a transport passage of the conveyor device.

In the above-described ash discharge system, the separation device may include: a housing which is provided with an entrance through which the clinker ash moves into the separation device, an exit through which the clinker ash moves out of the separation device toward the conveyor device, and a discharge port through which the large-mass clinker is discharged; and a discharge valve device which opens and closes the discharge port, and the separator may be provided at a passage of the clinker ash from the entrance to the exit.

In accordance with this configuration, the large-mass clinker having been separated from the main stream of the clinker ash by the separation device can be discharged to an outside region of the separation device through the discharge port. This makes it possible to avoid a situation in which the large-mass clinker remains unmoving inside the separation device. In addition, even if the large mass clinker remains unmoving inside the separation device, the large-mass clinker can be easily removed.

In the above-described ash discharge system, the exit and the discharge port may be provided at a bottom portion of the housing so that each of a perpendicular line of an opening plane of the exit and a perpendicular line of an opening plane of the discharge port may be inclined with respect to a vertical direction and inclinations of the perpendicular lines may include horizontal components with directions that are opposite to each other, and the separator may be disposed to close the opening plane of the exit.

In accordance with this configuration, the large-mass clinker is separated from the main stream of the clinker ash while the clinker ash is rolling over the separator, and the clinker ash having passed through the separator is sent to the conveyor device 4 through the exit. The large-mass clinker having been separated from the main stream reaches the discharge port opposed to the exit at the bottom portion of the housing, and is discharged through the discharge port.

In the above-described ash discharge system, a fireproof (refractory) material may be bonded to an inner portion of the housing.

h accordance with this configuration, the housing defining the passage of the clinker ash can have a heat resistant characteristic and a fireproof characteristic which can withstand the high-temperature clinker ash.

In the above-described ash discharge system, the separation device may further include an enclosure enclosing the discharge port of the housing, and the separation device may be configured to discharge the large-mass clinker into the enclosure through the discharge port.

In accordance with this configuration, it becomes possible to prevent diffusion of dust caused by the discharge of the large-mass clinker from the separation device and to isolate the high-temperature large-mass clinker from an outside region. Since the closed space including the interior of the separation device can be formed by the enclosure, a negative pressure inside the boiler furnace can be easily maintained.

In the above-described ash discharge system, the separation device may further include a sensor which detects the large-mass clinker present at the discharge port or in a region that is in the vicinity of the discharge port, and the discharge valve device may be configured to open the discharge port in a case where the sensor detects the large-mass clinker with a predetermined volume.

In accordance with this configuration, the large-mass clinker can be automatically discharged from the separation device, and it becomes possible to avoid a situation in which the large-mass clinker remains unmoving in the separation device.

The above-described ash discharge system may further comprise a feeding valve device which is provided at a passage of the clinker ash from the furnace bottom to the separation device, the feeding valve device being configured to open and close the passage from the furnace bottom to the separation device.

In accordance with this configuration, the feeding valve device is capable of performing switching between feeding of the clinker ash to the separation device and its downstream region, and stop of feeding of the clinker ash to the separation device and its downstream region.

In the above-described ash discharge system, the separator may include a casing which is detachably mountable on the housing defining the passage of the clinker ash from the furnace bottom to the conveyor device.

In accordance with this configuration, the separator including the casing can be easily mounted on and detached from the housing, and work for mounting and detaching the separator can be easily carried out.

The above-described ash discharge system may further include a placement unit including a support part and a plurality of wheels, the support part being configured to support the separator which is not mounted on the housing, in a state in which the separator has the same posture as a posture of the separator mounted on the housing.

By utilizing this placement unit, the separator can be moved in a state in which the separator has the same posture as that of the separator mounted on the housing. In this way, work for mounting and detaching the separator can be easily carried out.

Advantageous Effects of Invention

In accordance with the ash discharge system of the present invention, it becomes possible to separate a large-mass clinker which is a clinker with a size larger than a predetermined size, from a stream of clinker ash, in a passage of the clinker ash from the furnace bottom of a boiler furnace to a conveyor device.

DESCRIPTION OF EMBODIMENTS

Figure 1:
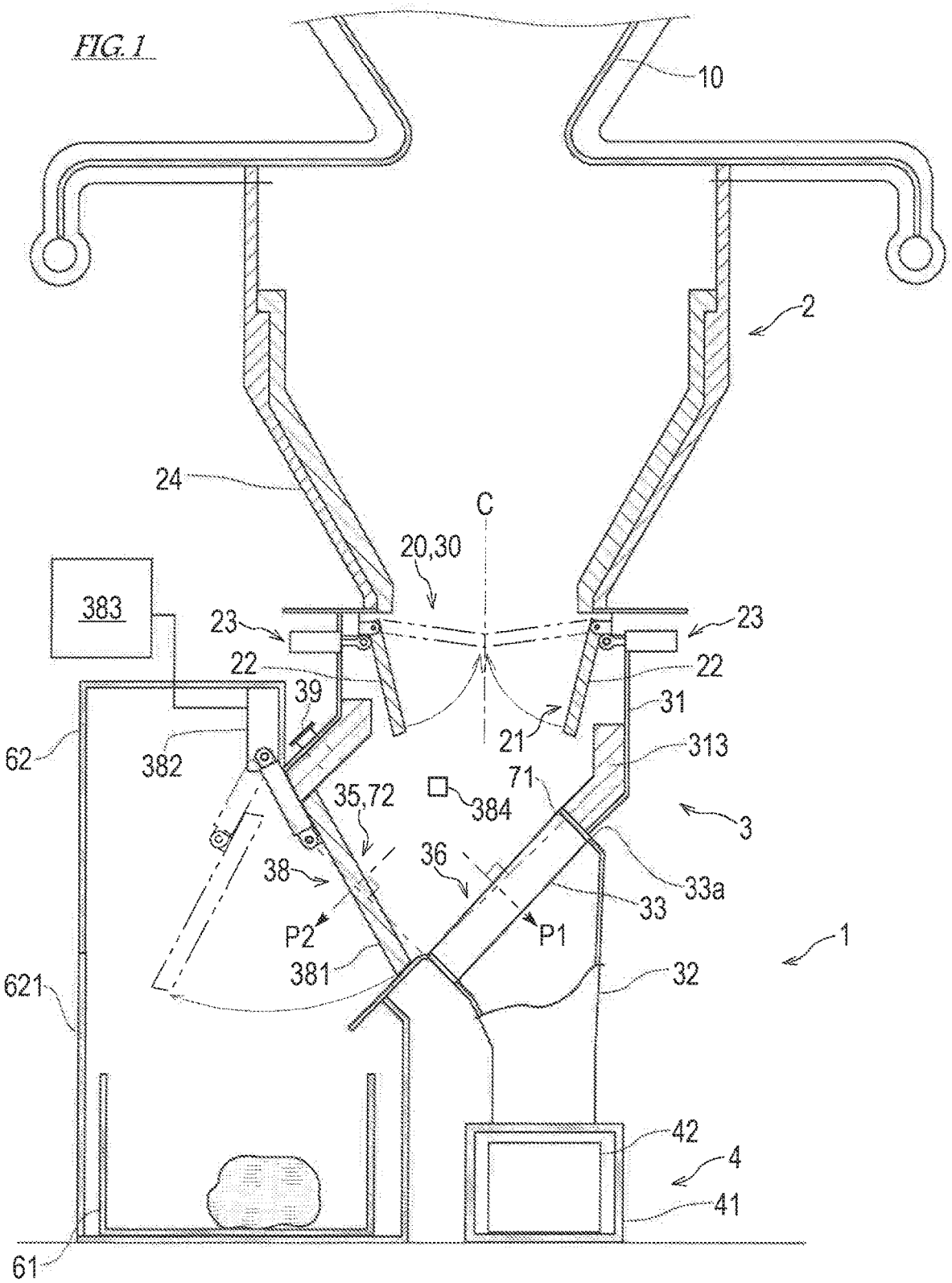
FIG. 1 is a conceptual view showing the schematic configuration of an ash discharge system according to an embodiment of the present invention.

Hereinafter, the embodiment of the present invention will be described with reference to the drawings. First of all, the schematic configuration of an ash discharge system 1 which discharges clinker ash from the furnace bottom of a boiler furnace 10 of a coal burning boiler according to the embodiment of the present invention will be described with reference to FIG. 1.

The ash discharge system 1 is a system which transports clinker ash (bottom ash) having fallen onto the furnace bottom of the boiler furnace 10, out of the boiler furnace 10. The ash discharge system 1 includes a hopper 2, a separation device 3, and a conveyor device 4, from an upstream side to a downstream side along a flow of movement of the clinker ash.

The hopper 2 is configured to receive the clinker ash falling from the boiler furnace 10 to the hopper 2, and to discharge the clinker ash to a downstream region (namely, the separation device 3). The hopper 2 is disposed below the boiler furnace 10, and coupled to the furnace bottom of the boiler furnace 10.

The separation device 3 is configured to receive the clinker ash discharged from the hopper 2, to separate the clinker ash (hereinafter will be referred to as a "large-mass clinker" for easier understanding of the description) with a size larger than a predetermined size, from a main stream of the clinker ash, to collect the large-mass clinker, and to discharge the remaining clinker ash (clinker ash other than the large-mass clinker) to a downstream region (namely, conveyor device 4). The structure of the separation device 3 will be described in detail later.

In a passage of the clinker ash between the hopper 2 and the separation device 3, or a passage from the hopper 2 to the separation device 3, there is provided a feeding valve device 21 capable of performing switching between feeding of the clinker ash to the separation device 3 and stop of feeding of the clinker ash to the separation device 3, or adjusting the amount of the clinker ash to be fed to the separation device 3.

The conveyor device 4 is configured to transport the clinker ash having passed through the separation device 3 to a downstream region while cooling the clinker ash. The conveyor device 4 includes a casing 41, and a conveyor transport unit 42 accommodated in the easing 41.

In the ash discharge system 1 having the above-described configuration, the clinker ash having fallen onto the furnace bottom of the boiler furnace 10 moves through the hopper 2, and is fed to the separation device 3. The separation device 3 separates the large-mass clinker from the main stream of the clinker ash. The main stream of the clinker ash from which the large-mass clinker has been removed is discharged to the conveyor device 4. The conveyor transport unit 42 of the conveyor device 4 transports the clinker ash to the downstream region. The clinker ash having been transported out of the furnace bottom of the boiler furnace 10 by the conveyor device 4, in the above-described manner, may be crushed into small pieces by a crusher (not shown) or may be collected by a collecting hopper (not shown).

Next, the configuration of the hopper 2 and the configuration of the separation device 3 will be described in detail.

The hopper 2 includes one or a plurality of cone sections 24 corresponding to a length in the lengthwise direction of the boiler furnace 10. The feeding valve device 21 is disposed at a discharge port 20 of each cone section 24 or below the discharge port 20. In the present embodiment, the feeding valve device 21 includes a plurality of flaps 22 and a driving mechanism 23 for driving the flaps 22. In an emergency the flaps 22 are closed to disconnect (cut-off) the passage, and thus the clinker ash can be temporarily held in the hopper 2. In addition to this, the feeding valve device 21 may be configured to operate the flaps 22 to steplessly or stepwisely adjust the opening rate (opening degree) of the feeding valve device 21 from a closed position to a fully opened position so that the flow rate (flow volume) of the clinker ash can be adjusted.

An entrance 30 of a housing 31 defining the passage of the clinker ash inside the separation device 3 is connected to the discharge port 20 of the cone section(s) 24 of the hopper 2. The housing 31 has a hopper shape (funnel shape) with a cross-sectional area reduced in a downward direction. A fireproof (refractory) material 313 with an impact resistance may be bonded to the inner portion of the housing 31.

The housing 31 is provided with the entrance 30 through which the clinker ash moves into the separation device 3, an exit 36 through which the clinker ash moves out of the separation device 3 toward the conveyor device 4, and a discharge port 35 through which the large-mass clinker is discharged. The housing 31 includes a first bottom portion 71 which is inclined with respect to a horizontal direction, and a second bottom portion 72 which is inclined with respect to the horizontal direction, in a direction opposite to the inclination direction of the first bottom portion 71. The first bottom portion 71 and the second bottom portion 72 cross each other at the bottom portion of the housing 31. In this structure, the bottom portion of the housing 31 has a shape which is narrowed at its bottom. The exit 36 of the housing 31 opens in the first bottom portion 71 of the housing 31. The discharge port 35 of the housing 31 opens in the second bottom portion 72 of the housing 31. Each of a perpendicular line P1 of an opening plane of the exit 36 and a perpendicular line P2 of an opening plane of the discharge port 35 is inclined with respect to a vertical direction. The inclinations of the perpendicular lines P1, P2 include horizontal components with directions that are opposite to each other. A separator 33 is disposed to close the opening plane of the exit 36. The opening plane is defined as a virtual plane formed by an opening edge. In the present embodiment, the first bottom portion 71 is located on an extension line of a center line C of the entrance 30, and the second bottom portion 72 is located to be distant in the horizontal direction from the extension line of the center line C of the entrance 30. In this structure, it is possible to prevent a situation in which the main stream of the clinker ash fed to the inside of the housing 31 of the separation device 3 directly falls onto the discharge port 35.

The separator 33 permits the clinker ash with a predetermined size or less to pass through the separator 33 and inhibits the clinker ash (large-mass clinker) with a size larger than the predetermined size from passing through the separator 33. The upper surface of the separator 33 is inclined 35 to 60 degrees with respect to the horizontal direction so that the clinker ash having fallen onto the separator 33 is screened (sieved) while rolling over the upper surface of the separator 33. In the present embodiment, the separator 33 includes a plurality of grizzly bars arranged in parallel. A gap (clearance) formed between the grizzly bars, namely, a screen opening (sieve opening, slit) is set to a value in a range of 200 to 400 mm. In the present embodiment, the clinker ash which cannot pass through the separator 33, to be precise, the clinker ash whose smallest side dimension is larger than the size of the screen opening, is the "large-mass clinker". Note that the structure of the separator 33 and the size of the screen opening are not limited to the above, and the dimension of the smallest side defining the large-mass clinker changes depending on the size of the screen opening of the separator 33.

The entrance of a chute 32 is connected to the lower surface of the separator 33. The exit of the chute 32 is connected to a casing 41 at a location that is above the conveyor transport unit 42 of the conveyor device 4. The chute 32 coupled to the separator 33 in this way defines a passage used to send (deliver) the clinker ash having passed through the separator 33 to the conveyor device 4.

The large-mass clinker which cannot pass through the separator 33 rolls over the upper surface of the separator 33 in a downward direction and reaches the discharge port 35 disposed at a location toward which the large-mass clinker having rolled out of the separator 33 moves. The lowermost position of the discharge port 35 is as high as or lower than the lowermost position of the entrance of the chute 32.

The discharge port 35 is provided with a discharge valve device 38 which opens and closes the discharge port 35. In the present embodiment, the discharge valve device 38 includes a flap 381 which is able to close the discharge port 35, a driving mechanism 382 for driving the flap 381, and a controller 383. The driving mechanism 382 is, for example, a hydraulic cylinder.

The separation device 3 includes a sensor 384 which detects the large-mass clinker having reached the discharge port 35. This sensor is at least one of, for example, a weight sensor which detects a change in a load applied to the flap 381 provided at the discharge valve device 38, an object detection sensor which detects an object present at discharge port 35, and an image sensor which detects the large-mass clinker based on an image or video of the discharge port 35 which is taken by a camera. The controller 383 of the discharge valve device 38 controls the driving mechanism 382 to operate the flap 381 so that the discharge port 35 is opened, in a case where the sensor 384 detects the large-mass clinker with a predetermined volume. Alternatively, the operator may visually check whether or not the large-mass clinker is present in a reserving space 37 through an inspection window 39 provided at the housing 31, and manually manipulate the discharge valve device 38. Or, the controller 383 of the discharge valve device 38 may be configured to open the discharge port 35 at predetermined time intervals measured by a timer.

The discharge port 35 is provided with an enclosure 62 enclosing the discharge port 35. In a state in which the discharge port 35 is opened, the interior of the enclosure 62 and the interior of the housing 31 of the separation device 3 are in communication with each other. The enclosure 62 forms a closed space including the interior of the separation device 3 and leading to the boiler furnace 10. Since the closed space can be formed by the enclosure 62, a negative pressure inside the boiler furnace 10 can be easily maintained.

Inside the enclosure 62, a container 61 is provided below the discharge port 35 to accommodate therein the large-mass clinker having fallen through the discharge port 35. The enclosure 62 is provided with an entrance/exit 621 to transport the container 61 to an outside region of the enclosure 62.

In the separation device 3 configured as described above, the clinker ash is fed to the inside of the housing 31 by the hopper 2 and falls onto the upper surface of the separator 33. The clinker ash having passed through the separator 33 is fed to the conveyor device 4 through the chute 32. In contrast, the large-mass clinker which cannot pass through the separator 33 rolls over the upper surface of the separator 33 and then reaches the discharge port 35. When the sensor 384 detects the large-mass clinker which is present in front of the discharge port 35, the discharge valve device 38 opens the discharge port 35 which is closed in a steady state. By opening the discharge port 35, the large-mass clinker is discharged from the housing 31 through the discharge port 35, falls onto the container 61 and is accommodated in the container 61. In the above-described manner, the separation device 3 separates the large-mass clinker from the main stream of the clinker ash in the ash discharge system 1, and the separated large-mass clinker is collected.

In the separation device 3 configured as described above, the separator 33 receives a strong impact from the clinker ash falling from the hopper 2 onto the separator 33. For this reason, the separator 33 suffers from a significant fatigue or deformation compared to the other components. To keep the function of the separator 33, the separator 33 is changed (replaced) at regular intervals or as necessary. In view of this, the separator 33 is configured to be detachably mountable on the housing 31 so that maintenance work including the change (replacement) of the separator 33 can be easily carried out. Specifically, the separator 33 includes a casing 33*a* which is detachably mountable on the housing 31. The casing 33*a* is joined to the housing 31 and the chute 32 by use of fastening members (not shown) including bolts and nuts. The casing 33*a* forms a part of the passage of the clinker ash, from the furnace bottom of the boiler furnace 10 to the conveyor device 4. Since the separator 33 including the casing 33*a* is detachably mountable on the housing 31 as described above, work for mounting and detaching the separator 33 can be easily carried out.

Figure 2:
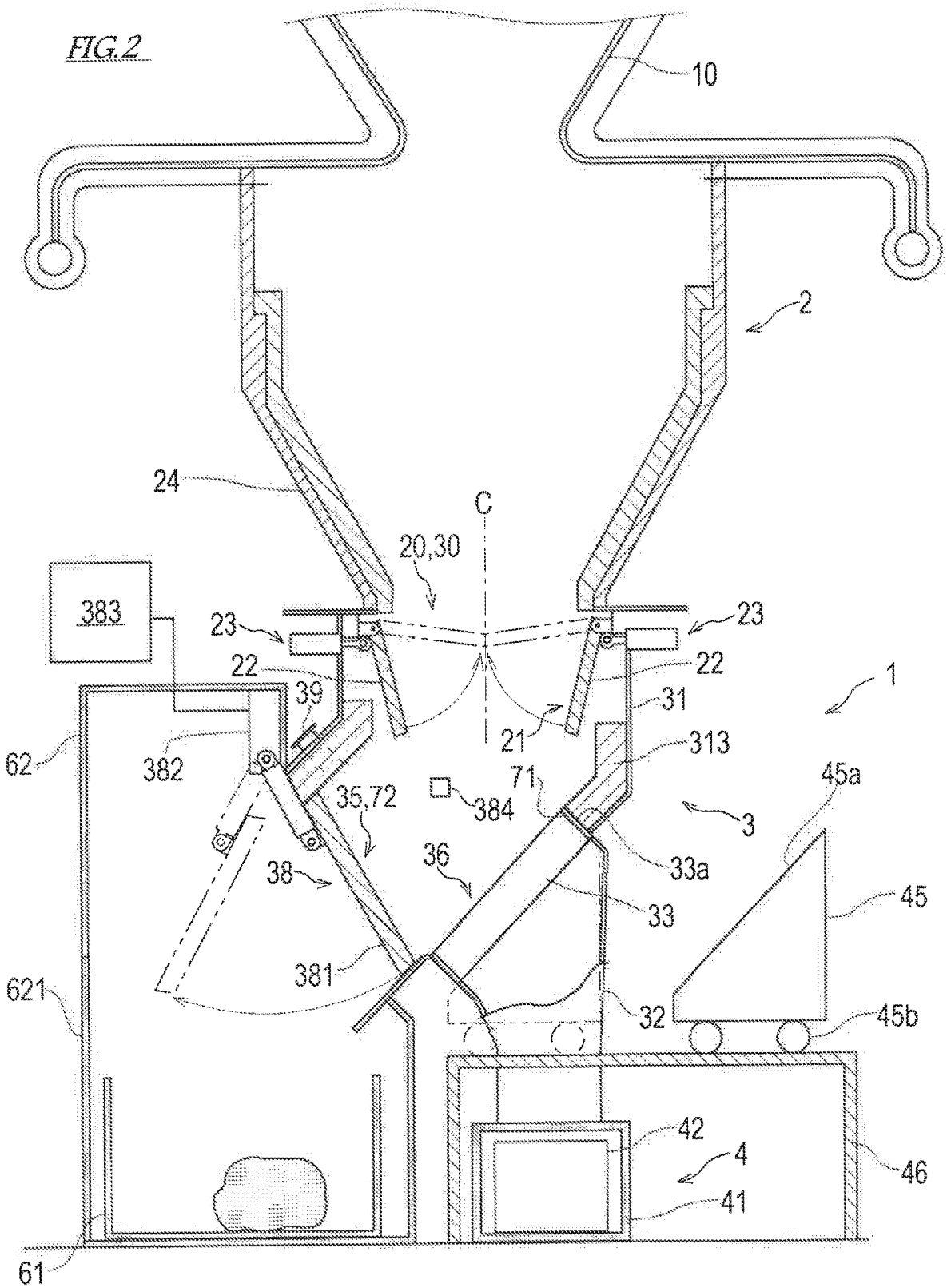
FIG. 2 is a conceptual view showing the schematic configuration of an ash discharge system according to a modified example.

Further, as shown in FIG. 2, the separation device 3 may include a temporary placement unit (placement unit) 45 which supports the separator 33 which is detached from the housing 31 (not mounted on the housing 31), during maintenance. The temporary placement unit 45 may be provided at the separation device 3 or may be used only during the maintenance.

The casing 33*a* of the separator 33 is mounted on the housing 31 in a state in which the casing 33*a* is inclined with respect to the horizontal direction, to correspond to the inclination of the opening of the exit 36 of the housing 31. The temporary placement unit 45 includes a support part 45*a* which supports the separator 33 in a state in which the separator 33 is inclined with respect to the horizontal direction, as in a state in which the separator 33 is mounted on the housing 31. The temporary placement unit 45 is able to move the support part 45*a*, and hence, the separator 33 supported by the support part 45*a*. Although in the present embodiment, the temporary placement unit 45 is a carrier which includes a plurality of wheels 45*b* and is able to travel, the temporary placement unit 45 is not limited to the above so long as it can move the support part 45*a*. For example, the temporary placement unit 45 may be an up-down unit including a jack which is able to move the support part 45*a* up and down. The separator 33 supported by the temporary placement unit 45 is inclined with respect to the horizontal direction, as in a state in which the separator 33 is mounted on the housing 31. By utilizing the temporary placement unit 45 in this way, the separator 33 can be moved in a state in which the separator 33 has the same posture as that of the separator 33 mounted on the housing 31. Therefore, the work for mounting and detaching the separator 33 can be easily carried out.

In the present embodiment, the temporary placement unit 45 is placed on a support frame 46. The temporary placement unit 45 travels on the support frame 46 and is advanceable and retractable with respect to the exit 36 of the housing 31. Note that the temporary placement unit 45 may include an up-down device (not shown) which moves the support part 45*a* up and down. The temporary placement unit 45 can make the separator 33 approach the housing 31 to a location where the separator 33 is mounted on the housing 31. In addition, the temporary placement unit 45 can move the separator 33 away from the housing 31 to a location where the separator 33 does not interfere with the housing 31 and the conveyor device 4. The support frame 46 may be provided to extend across a region that is over the conveyor device 4, or may be omitted by providing legs on the temporary placement unit 45.

As described above, the ash discharge system 1 of the present embodiment includes the conveyor device 4 which transports the clinker ash out of a region that is below the furnace bottom of the boiler furnace 10, and the separation device 3 provided at the passage of the clinker ash from the furnace bottom to the conveyor device 4, the separation device 3 including the separator 33 which permits the clinker ash with the predetermined size or less to pass through the separator 33 and inhibits the large-mass clinker which is the clinker ash with a size larger than the predetermined size, from passing through the separator 33.

In accordance with the ash discharge system 1 of the present embodiment, in the passage of the clinker ash from the furnace bottom of the boiler furnace 10 to the conveyor device 4, the large-mass clinker which is the clinker with a size larger than the predetermined size is separated from the main stream of the clinker ash. Only the clinker ash with the predetermined size or less falls onto the conveyor device 4. This makes it possible to prevent a situation in which the large-mass clinker remains unmoving on the transport passage of the clinker ash in the conveyor device 4. In addition, since an impact applied to the conveyor device 4 when the clinker ash is falling onto the conveyor device 4 can be mitigated, impact resistance of the conveyor device 4 can be reduced and the width and height of the conveyor device 4 can be reduced, compared to the conventional conveyor configured to transport the large-mass clinker. As a result, flexibility of layout of the ash discharge system 1 can be improved.

In the ash discharge system 1 of the present embodiment, the separation device 3 includes the housing 31 provided with the entrance 30 through which the clinker ash moves into the separation device 3, the exit 36 through which the clinker ash moves out of the separation device 3 toward the conveyor device 4, and the discharge port 35 through which the large-mass clinker is discharged, and the discharge valve device 38 which opens and closes the discharge port 35.

In accordance with this configuration, since the discharge valve device 38 opens the discharge port 35, the large-mass clinker having been separated from the main stream of the clinker ash can be discharged to the outside region of the separation device 3 through the discharge port 35. Therefore, it becomes possible to prevent a situation in which the large-mass clinker remains unmoving inside the separation device 3. Even if the large-mass clinker remains unmoving inside the separation device 3, the large-mass clinker can be easily removed.

In the ash discharge system 1 of the present embodiment, each of the perpendicular line P1 of the opening plane of the exit 36 and the perpendicular line P2 of the opening plane of the discharge port 35 is inclined with respect to the vertical direction, and the exit 36 and the discharge port 35 are provided at the bottom portion of the housing 31 so that the inclinations of the perpendicular lines P1, P2 include horizontal components with directions that are opposite to each other. The separator 33 is disposed to close the opening plane of the exit 36.

In accordance with this configuration, the large-mass clinker is separated from the main stream of the clinker ash while the clinker ash is rolling over the separator 33, and the clinker ash having passed through the separator 33 is sent to the conveyor device 4 through the exit 36. The large-mass clinker having been separated from the main stream reaches the discharge port 35 opposed to the exit 36 at the bottom portion of the housing 31, and is discharged through the discharge port 35. Since the discharge port 35 is provided on a side opposite to the exit 36, at the bottom portion of the housing 31, a space (in the present embodiment, space defined by the enclosure 62) into which the large-mass clinker is discharged through the discharge port 35 can be ensured at a location that is adjacent to the housing 31.

In the ash discharge system 1 of the present embodiment, the fireproof (refractory) material 313 is bonded to the inner portion of the housing 31.

In accordance with this configuration, the housing 31 defining the passage of the clinker ash can have a heat resistant characteristic and a fireproof characteristic which can withstand the high-temperature clinker ash.

In the ash discharge system 1 of the present embodiment, the separation device 3 further includes the enclosure 62 enclosing the discharge port 35 of the housing 31, and is configured to discharge the large-mass clinker into the enclosure 62 through the discharge port 35.

In accordance with this configuration, the large-mass clinker is discharged from the separation device 3 to the closed space formed by the enclosure 62, through the discharge port 35. This makes it possible to prevent diffusion of dust caused by the discharge of the large-mass clinker and to isolate the high-temperature large-mass clinker from an outside region.

In the ash discharge system 1 of the present embodiment, the separation device 3 includes the sensor which detects the large-mass clinker present at the discharge port 35 or in a region that is in the vicinity of the discharge port 35, and the discharge valve device 38 is configured to open the discharge port 35, in a ease where the sensor detects the large-mass clinker with a predetermined volume.

In accordance with this configuration, the large-mass clinker can be automatically discharged from the separation device 3, and it becomes possible to avoid a situation in which the large-mass clinker remains unmoving inside the separation device 3. The large-mass clinker is not generated so frequently. However, the large-mass clinker impedes the normal flow of movement of the clinker ash in the ash discharge system 1. Since the large-mass clinker is automatically discharged as described above, the labor of an operator can be saved, and the stable operation of the ash discharge system 1 can be maintained.

The ash discharge system 1 of the present embodiment further includes the feeding valve device 21 provided at the passage of the clinker ash from the furnace bottom of the boiler furnace 10 to the separation device 3, the feeding valve device 21 being configured to open and close this passage.

In accordance with this configuration, the feeding valve device 21 is capable of performing switching between feeding of the clinker ash to the separation device 3 and its downstream region, and stop of feeding of the clinker ash to the separation device 3 and its downstream region. Therefore, for example, in a case where the separation device 3 or a device provided downstream of the separation device 3 does not operate properly, the feeding valve device 21 closes the passage of the clinker ash, and maintenance can be performed.

In the ash discharge system 1 of the present embodiment, the separator 33 includes the casing 33*a* which is detachably mountable on the housing 31 defining the passage of the clinker ash from the furnace bottom of the boiler furnace 10 to the conveyor device 4.

In accordance with this configuration, in a case where the separator 33 is changed (replaced), the separator 33 including the casing 33*a* can be detached from the housing 31. In addition, the separator 33 including the casing 33*a* can be changed (replaced). In this way, work for mounting and detaching the separator 33 and maintenance work for the separator 33 can be easily carried out.

The ash discharge system 1 of the present embodiment includes the temporary placement unit (placement unit) 45 including the support part 45*a* which supports the separator 33 which is not mounted on the housing 31, in a state in which the separator 33 has the same posture as that of the separator 33 mounted on the housing 31. The separator 33 which is not mounted on the housing 31 includes, for example, the separator 33 detached from the housing 31 and the separator 33 which is to be mounted on the housing 31.

By utilizing the temporary placement unit 45, the separator 33 detached from the housing 31 can be handled in a state in which the separator 33 has the same posture as that of the separator 33 mounted on the housing 31. In this way, work for mounting and detaching the separator 33 and maintenance work for the separator 33 can be easily carried out.

The preferred embodiment of the present invention has been described above. The above-described configuration can be changed as follows.

The ash discharge system 1 of the present embodiment employs the conveyor method in which the ash in a dry state is taken out of the boiler furnace 10. The configuration of the separation device 3 in the ash discharge system 1 is applicable to the ash discharge system which employs a submerged (wet) conveyor method. In a case where the separation device 3 is applicable to the ash discharge system which employs the submerged conveyor method, a wet-type clinker hopper may be used as the hopper 2 having the above-described configuration, and a submerged scraper conveyor device or a submerged chain conveyor device may be used as the conveyor device 4.

The description is to be construed as illustrative only, and is provided for the purpose of teaching those skilled in the art the best mode of conveying out the invention. The details of the structure and/or function may be varied substantially without departing from the spirit of the invention.

REFERENCE SIGNS LIST

1 ash discharge system
2 hopper

3 separation device
4 conveyor device
10 boiler furnace
21 feeding valve device
30 entrance
31 housing
32 chute
33 separator
35 discharge port
36 exit
38 discharge valve device
45 temporary placement unit (placement unit)
61 container
62 enclosure
71 first bottom portion
72 second bottom portion
381 flap
382 driving mechanism

The invention claimed is:

1. An ash discharge system which discharges clinker ash from a furnace bottom of a boiler furnace, the ash discharge system comprising:

a conveyor device which transports the clinker ash out of a region that is below the furnace bottom; and a separation device provided at a passage of the clinker ash from the furnace bottom to the conveyor device, the separation device including a separator which permits the clinker ash with a predetermined size or less to pass through the separator, and inhibits a large-mass clinker from passing through the separator, the large-mass clinker being the clinker ash with a size larger than the predetermined size, wherein the separation device includes: (i) a housing which is provided with an entrance through which the clinker ash moves into the separation device, an exit through which the clinker ash moves out of the separation device toward the conveyor device, and a discharge port through which the large-mass clinker is discharged; and (ii) a discharge valve device which opens and closes the discharge port, the entrance and exit being configured to be open in a state in which the discharge valve device is closed, and wherein the separator is provided at a passage of the clinker ash from the entrance to the exit.

2. The ash discharge system according to claim 1, wherein the exit and the discharge port are provided at a bottom portion of the housing so that each of (i) a line perpendicular to an opening plane of the exit and (ii) a line perpendicular to an opening plane of the discharge port is inclined with respect to a vertical direction, and inclinations of the perpendicular lines include horizontal components with directions that are opposite to each other, and wherein the separator is disposed to close the opening plane of the exit.

3. The ash discharge system according to claim 1, wherein a fireproof material is bonded to an inner portion of the housing.

4. The ash discharge system according to claim 1, wherein the separation device further includes an enclosure enclosing the discharge port of the housing, and not enclosing the exit, and wherein the separation device is configured to discharge the large-mass clinker into the enclosure through the discharge port.

5. The ash discharge system according to claim 1, wherein the separation device further includes a sensor which detects the large-mass clinker present at the discharge port or in a region that is in the vicinity of the discharge port, and wherein the discharge valve device is configured to open the discharge port in a case where the sensor detects the large-mass clinker with a predetermined volume.

6. The ash discharge system according to claim 1, further comprising:

a feeding valve device, separate from the discharge valve device, which is provided at a passage of the clinker ash from the furnace bottom to the separation device, the feeding valve device being configured to open and close the passage from the furnace bottom to the separation device.

7. The ash discharge system according to claim 1, wherein the separator includes a casing which is detachably mountable on the housing defining the passage of the clinker ash from the furnace bottom to the conveyor device.

8. The ash discharge system according to claim 7, further comprising:

a placement unit including a support part which supports the separator which is not mounted on the housing, in a state in which the separator has the same posture as a posture of the separator mounted on the housing.

9. An ash discharge system which discharges clinker ash from a furnace bottom of a boiler furnace, the ash discharge system comprising:

a conveyor device which transports the clinker ash out of a region that is below the furnace bottom; and a separation device provided at a passage of the clinker ash from the furnace bottom to the conveyor device, the separation device including a separator which permits the clinker ash with a predetermined size or less to pass through the separator, and inhibits a large-mass clinker from passing through the separator, the large-mass clinker being the clinker ash with a size larger than the predetermined size, wherein the separation device further includes: (i) a housing which is provided with an entrance through which the clinker ash moves into the separation device, an exit through which the clinker ash moves out of the separation device toward the conveyor device, and a discharge port through which the large-mass clinker is discharged; (ii) a discharge valve device which opens and closes the discharge port; and (iii) a sensor which detects the large-mass clinker present at the discharge port or in a region that is in the vicinity of the discharge port, wherein the separator is provided at a passage of the clinker ash from the entrance to the exit, and wherein the discharge valve device is configured to open the discharge port in a case where the sensor detects the large-mass clinker with a predetermined volume.

10. An ash discharge system which discharges clinker ash from a furnace bottom of a boiler furnace, the ash discharge system comprising:

a conveyor device which transports the clinker ash out of a region that is below the furnace bottom;

a separation device provided at a passage of the clinker ash from the furnace bottom to the conveyor device, the separation device including a separator which permits the clinker ash with a predetermined size or less to pass through the separator, and inhibits a large-mass clinker from passing through the separator, the large-mass clinker being the clinker ash with a size larger than the predetermined size, the separator including a casing which is detachably mountable on the housing defining the passage of the clinker ash from the furnace bottom to the conveyor device; and a placement unit including a support part which supports the separator which is not mounted on the housing, in a state in which the separator has the same posture as a posture of the separator mounted on the housing.

* * * * *